United States Patent [19]

Hrycak

[11] Patent Number: 4,633,259

[45] Date of Patent: Dec. 30, 1986

[54] LOSSLESS ORTHOGONAL BEAM FORMING NETWORK

[75] Inventor: Peter D. Hrycak, Millersville, Md.

[73] Assignee: Westinghouse Electric Corp., Pittsburgh, Pa.

[21] Appl. No.: 629,530

[22] Filed: Jul. 10, 1984

[51] Int. Cl.[4] ..... H01Q 3/22; H01Q 3/24

[52] U.S. Cl. ..... 342/373

[58] Field of Search ..... 343/368, 371, 373

[56] References Cited

U.S. PATENT DOCUMENTS

| | | | |
|---|---|---|---|
| 3,255,450 | 6/1966 | Butler | 343/373 |
| 3,293,648 | 12/1966 | Kuhn | 343/368 |
| 3,295,134 | 12/1966 | Lowe | 343/368 |
| 4,123,759 | 10/1978 | Hines et al. | 343/371 X |
| 4,231,040 | 10/1980 | Walker | 343/373 |
| 4,424,500 | 1/1984 | Viola et al. | 343/373 X |
| 4,499,471 | 2/1985 | Luh | 343/373 |
| 4,503,434 | 5/1985 | Luh | 343/373 |

OTHER PUBLICATIONS

"A New Class of Broad-Band Microwave 90-Degree Phase Shifters", B. M. Schiffman, IRE Trans. on Microwave Theory and Techniques, Apr. 1958, pp. 230-237.

*Primary Examiner*—Theodore M. Blum
*Assistant Examiner*—John B. Sotomayor
*Attorney, Agent, or Firm*—W. G. Sutcliff

[57] ABSTRACT

A six port junction (10) having relatively wide bandwidth, forms a basic building block for implementing a non-binary matrix and is comprised of a network including two 3-dB quadrature couplers (14, 16), one 4.8-dB quadrature coupler (18) and three coupled stripline transmission line fixed phase shifters (20, 22, 24) providing phase shifts of substantially −90°, −240° and −30° to provide a 120° phase progression between three input ports (A, B, C). The six port junction can be combined with other like non-binary matrices or binary matrices for forming a beam forming network which is adapted to provide $2^n \times 3^m$ outputs.

16 Claims, 4 Drawing Figures

LOSSLESS ORTHOGONAL BEAM FORMING NETWORK

BACKGROUND OF THE INVENTION

1. Field of the Invention

This invention relates generally to phased array antenna systems and more particularly to an orthogonal beam forming network for simultaneously providing multiple beams from a single aperture.

2. Description of the Prior Art

In radar systems, multiple beams allow parallel operation and a higher data rate than can be obtained from a single beam. In communications systems they allow for reuse of frequency and data transmission to different areas. Moreover, if these beams are comprised of sin x/x beams, they can be formed independently and losslessly. If there is provided an N element array with element spacing d, then N (sin x/x) beams can be formed which are spaced $\lambda/N \times d$ in space and where $\lambda$ is the operating wavelength. As is well known, the expression for the angle $\alpha$ of the progressive phase fronts required to form a set of orthogonal sin x/x beams can be stated as:

$$\alpha_m = \frac{180}{N}(2m - N - 1) \text{ degrees}$$

where m is the beam number and N is the number of elements in the array. Also as is well known, sin x/x beams have relatively high sidelobe levels but they can be combined to form beams with much lower sidelobe levels by providing an amplitude taper.

Until recently, the only network utilized for forming a lossless set of orthogonal sin x/x beams was the well known Butler matrix which has a binary number ($2^n$) of input ports and output ports coupled to a binary number of antenna elements notwithstanding the fact that an article entitled, "Multiple Beams From Linear Arrays", J. P. Shelton and K. S. Kelleher, *IRE Transactions On Antennas And Propagation,* Mar., 1961, pp. 154–161, showed that other numbers of elements are theoretically possible using all values of $3^m \times 2^n$ through the use of a six port junction. One such six port network has furthermore been disclosed, in U.S. Pat. No. 4,231,040, entitled, "Simultaneous Multiple Beam Antenna Array Matrix And Method Thereof", S. Walker, Oct. 28, 1980. Such an arrangement, however, comprises a narrow bandwidth device since both the amplitude and output phase is far from being constant as a function of frequency.

Accordingly, it is an object of the present invention to provide an improvement in orthogonal beam forming networks coupled to a plurality of phased array antenna elements.

Another object of the invention is to provide an improvement in non-binary matrices for forming multiple antenna beams.

Still another object of the invention is to provide an improved six port junction for forming orthogonal antenna beams in a phased array.

SUMMARY

Briefly, the foregoing and other objects of the invention are provided in accordance with an orthogonal beam forming network comprising at least one six port junction having three input ports and three output ports and including a pair of first type (3-dB) quadrature couplers and one second type (4.8-dB) quadrature coupler, each having two input ports and two output ports, with one of the input ports of the 4.8-dB coupler and both input ports of one of the pair of 3-dB couplers forming the three input ports of the six port junction, with one of the output ports of one 3-dB coupler being directly coupled to the other input port of the 4.8-dB coupler, first fixed phase shift means (−90°) coupling the other output port of said one first type coupler to one of the input ports of the other or second 3-dB coupler, with one of the output ports of the 4.8-dB coupler being directly connected to the other input port of the second 3-dB coupler, second fixed phase shift means (−240°) coupling the other output port of the 4.8-dB coupler to an output port forming one of the output ports of the six port junction, third fixed phase shift means (−30°) coupling one output port of the second 3-dB coupler to another output port forming the second of the three output ports of the six port junction and the other output port of the second 3-dB coupler functioning as and forming the third output port of the six port junction, whereby a non-binary phased array matrix is formed providing a 120° progressive phase front.

DESCRIPTION OF THE PREFERRED EMBODIMENTS

Figure 1:
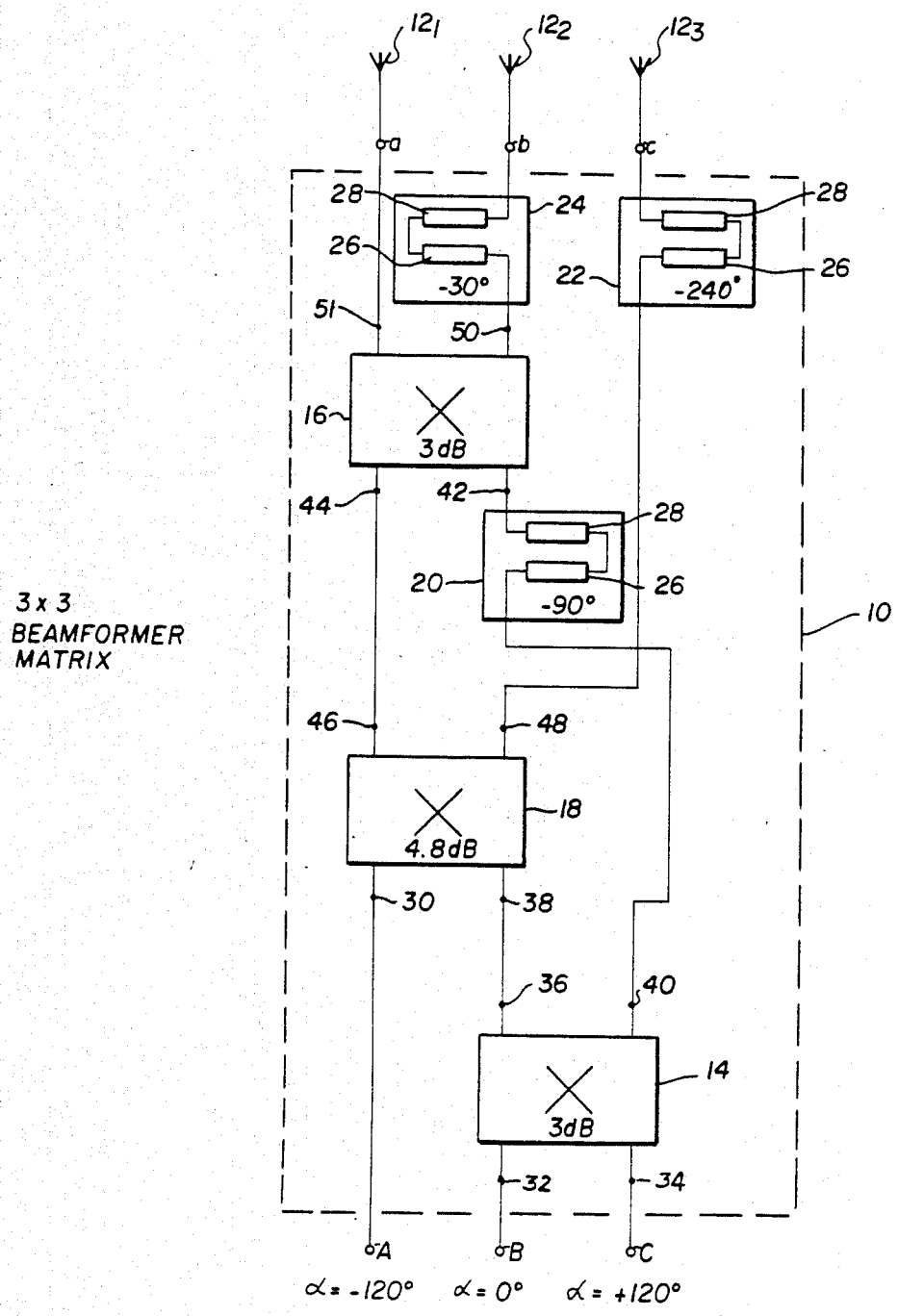
FIG. 1 is an electrical block diagram of a nonlinear matrix illustrating the preferred embodiment of the invention.

Referring now to the drawings and more particularly to FIG. 1, disclosed thereat is an embodiment of an improved six port junction in accordance with the subject invention and one defining a 3×3 non-binary signal combiner or beamformer matrix 10 having three output ports a, b and c respectively coupled to three phased array antenna elements $\mathbf{12}_1$, $\mathbf{12}_2$ and $\mathbf{12}_3$. The input ports are designated A, B and C and with the configuration shown, provide respective progressive phase front angles $\alpha$ of −120°, 0°, and +120°.

The six port junction 10 of FIG. 1 comprises a reciprocal network in that power transfer will be the same for both transmission and reception and is further comprised of a pair of 3-dB couplers 14 and 16, a single 4.8-dB coupler 18 and three fixed phase shift elements 20, 22 and 24 which respectively provide fixed phase shifts of −90°, −240°, and −30°. These phase shifters, moreover, employ sections of coupled strip transmission lines which operate in the TEM mode and typically consist of two parallel coupled lines 26 and 28 of equal length that are connected at one end. This type of device belongs to a class of broadband microwave phase shifters disclosed, for example, by B. M. Schiffman, in the *IRE Transactions On Microwave Theory And Techniques,* April, 1958, at pp. 230–237, inclusive.

The three couplers 14, 16 and 18 comprise four port quadrature couplers having two input ports and two output ports which supply signals at the respective output ports that are mutually 90° out of phase. The 3-dB couplers 14 and 16 comprise quadrature couplers wherein power applied to either input port is split approximately equally between the two output ports, whereas the 4.8-dB coupler comprises a coupler that power applied to either of the input ports is split approximately 2 to 1 at the outputs with two thirds times the power input appearing at the output port directly opposite the input port receiving the power and one third times the input power appearing at the diagonally located output terminal.

The preferred embodiment of the invention as shown in FIG. 1 comprises the foregoing elements specifically connected in the following manner. One of the input ports 30 of the 4.8-dB coupler 18 and both input ports 32 and 34, while being shown separately and distinct, normally function as the three input ports A, B and C. One of the output ports 36 of the 3-dB coupler 14 is directly coupled to the other input port 38 of the 4.8-dB coupler 18. The −90° fixed phase shifter 20 is coupled from the other output port 40 to one of the input ports 42 of the second 3-dB coupler 16. The other input port 44 of the 3-dB coupler 16 is directly connected to one output port 46 of the 4.8-dB coupler 18. The other output port 48 of the 4.8-dB coupler 18 is coupled to the output port c of the six port junction 10 by means of the fixed −240° fixed phase shifter 22. The −30° fixed phase shifter 24 couples one output 50 of the 3-dB coupler 16 to output port b of the six port junction 10 while the second output port 51 effectively forms and functions output port a of the six port junction.

The amplitudes and phases produced by the configuration shown in FIG. 1 are those required to form three orthogonal sin x/x beams with a three element array; however, this specific 3×3 non-binary matrix 10 can be combined with one or more binary Butler matrices, which in its simplest form comprises a single 3-dB 2×2 branch line coupler, to provide the basic building blocks to configure orthogonal beam formers operable with $2^n \times 3^m$ elements respectively forming $2^n \times 3^m$ orthogonal sin x/x beams. Examples of such networks are shown in FIGS. 2 through 4.

Figure 2:
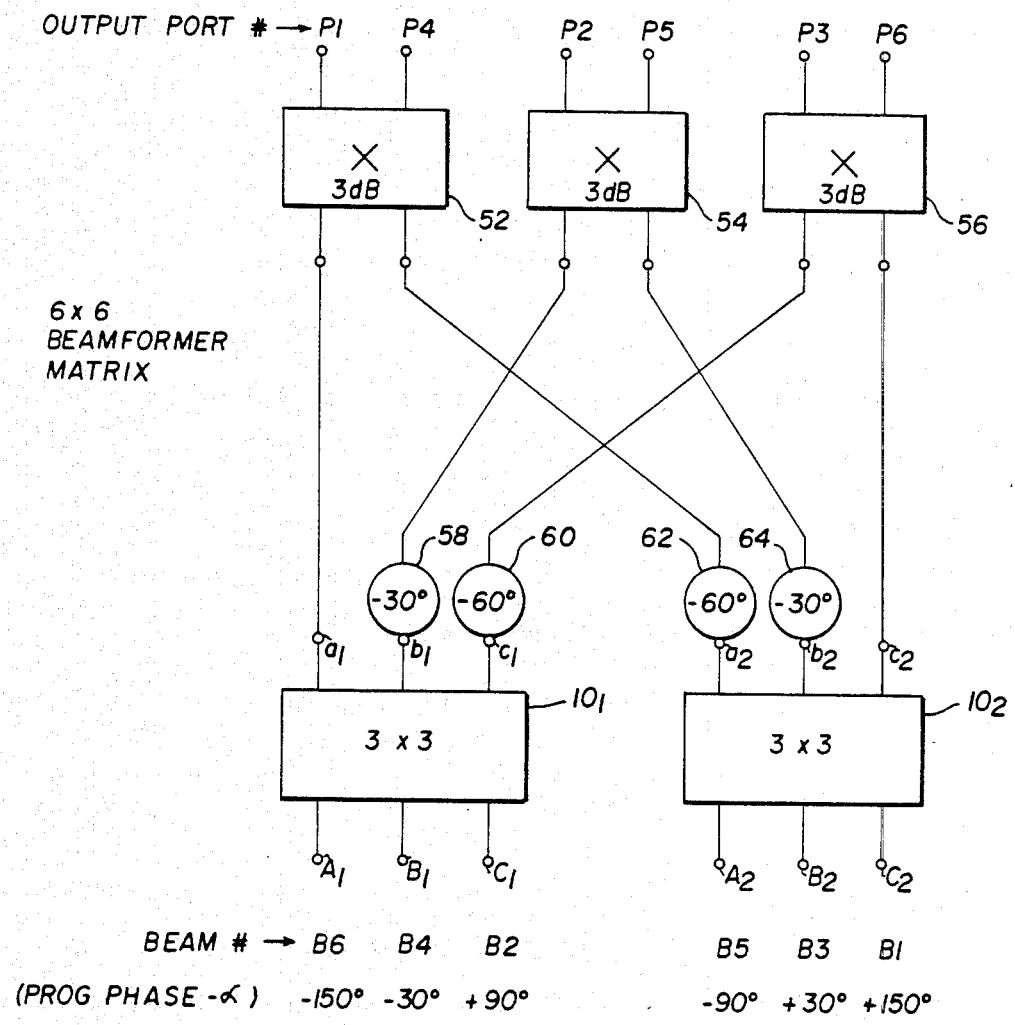
FIGS. 2 through 4 electrical block diagrams illustrative of various types of expanded orthogonal beam forming networks utilizing the embodiment shown in FIG. 1.

Referring now to FIG. 2, shown therein is a 6×6 beamformer matrix comprised of two 3×3 matrices $\mathbf{10}_1$ and $\mathbf{10}_2$ having their respective output ports $a_1$, $b_1$, $c_1$ and $a_2$, $b_2$, $c_2$ interlaced to a second level of 3-dB quadrature four port couplers 52, 54 and 56 through a set of four fixed phase shifters 58, 60, 62 and 64. Further as shown, the two input ports of the 3-dB coupler 52 are coupled to the output ports $a_1$ and $a_2$ of the 3×3 matrices $\mathbf{10}_1$ and $\mathbf{10}_2$ with the exception that the output port $a_2$ is coupled to the input port of 3-dB coupler 52 by means of the fixed phase shifter 62 which provides a −60° phase shift. The two input ports of the 3-dB coupler 54 are coupled to the intermediate output ports $b_1$ and $b_2$ through the fixed phase shifters 58 and 64 which provide a phase shift of −30°. The two input ports of the 3-dB coupler 56 are coupled to the intermediate output ports $c_1$ and $c_2$; however, a −60° fixed phase shifter 60 couples port $c_1$ to one input of coupler 56 while the other input is directly coupled to intermediate output terminal $c_2$. It can be seen that the arrangement is nevertheless symmetrical. With beam B6 being considered the left-most beam, six beams B1 through B6 are separately provided at the input ports $A_1$, $B_1$, $C_1$, $A_2$, $B_2$, $C_2$ as shown and the progressive phase fronts defined by angle $\alpha$ for the six beam ranges between −150° and +150° where the output port P1 is considered the left-most port coupled to respective antenna elements, not shown, of a multi-element array.

Figure 3:
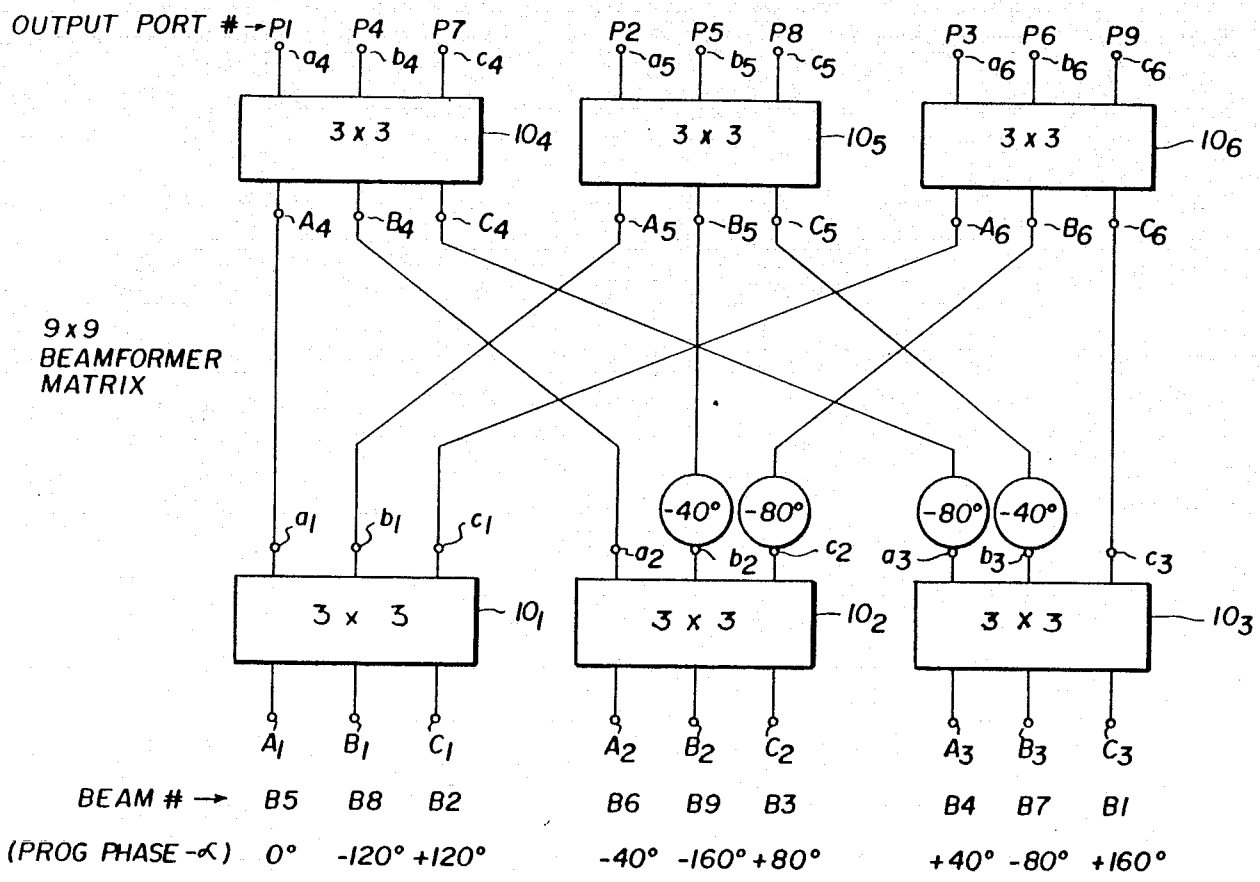
Figure 4:
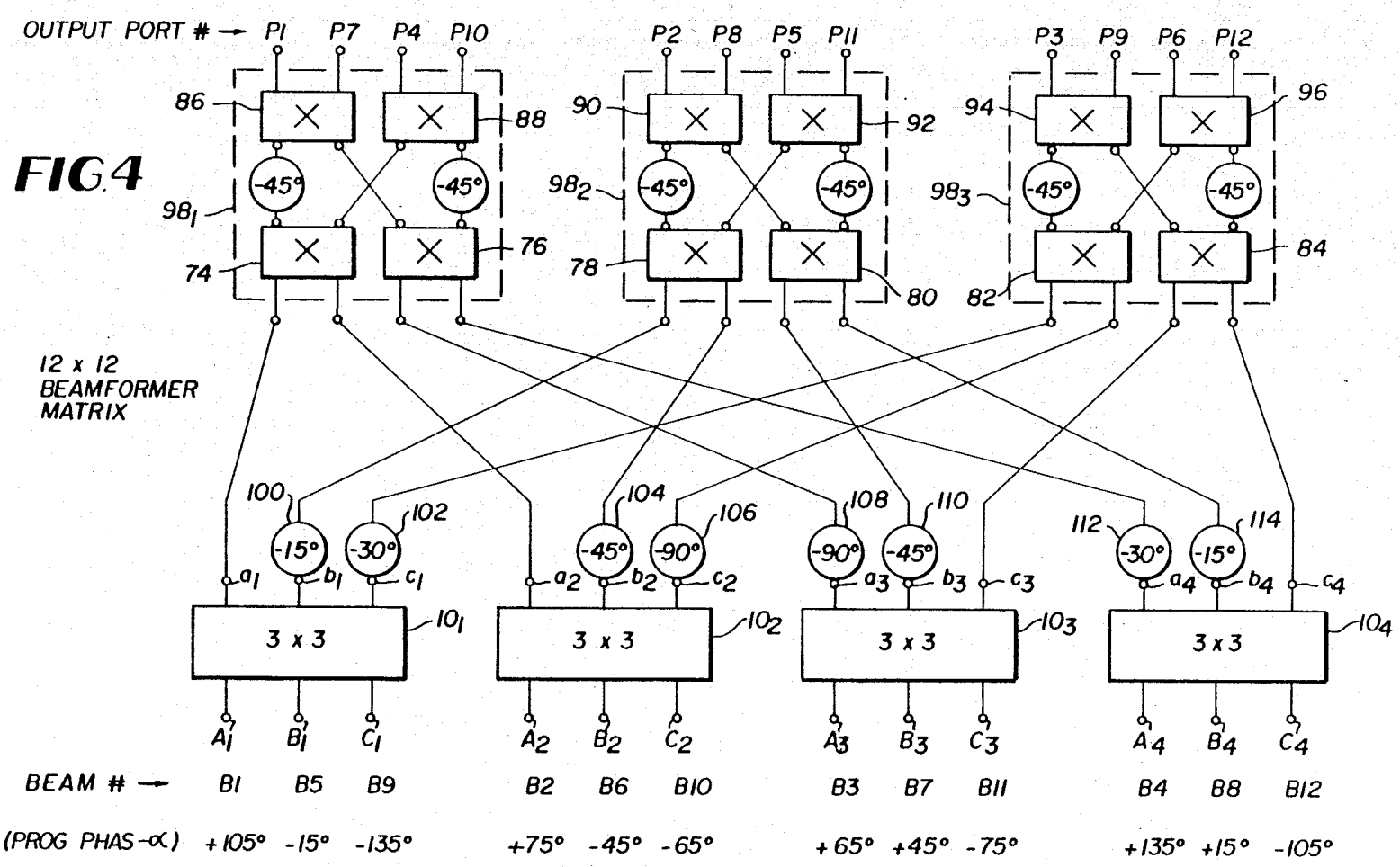

Referring now to FIG. 3, shown therein is a 9×9 beamformer matrix comprised of a first level of 3×3 matrices $\mathbf{10}_1$, $\mathbf{10}_2$ and $\mathbf{10}_3$ interlaced with a second level of 3×3 matrices $\mathbf{10}_4$, $\mathbf{10}_5$ and $\mathbf{10}_6$. As illustrated, the intermediate output ports $a_1$, $b_1$ and $c_1$ of matrix $\mathbf{10}_1$ are respectively coupled to the first input port $A_4$, $A_5$ and $A_6$ of the second level matrices $\mathbf{10}_4$, $\mathbf{10}_5$ and $\mathbf{10}_6$. The intermediate output ports $a_2$, $b_2$ and $c_2$ of matrix $\mathbf{10}_2$ are respectively coupled to the second input port $B_4$, $B_5$ and $B_6$ with two fixed phase shifters 66 and 68 having phase shifts of −40° and −80° coupled into the lines between ports $b_2$ and $B_5$ and $c_2$ and $B_6$. The three intermediate output ports $a_3$, $b_3$ and $c_3$ of matrix $\mathbf{10}_3$ respectively couple to the input ports $C_4$, $C_5$ and $C_6$ but with a pair of fixed phase shifters 70 and 72 respectively being coupled in the lines between ports $a_3$ and $C_4$ and $b_3$ and $C_5$. Such an arrangement provides nine output ports P1, P2, P3 . . . P9 which respectively correspond to the ports $a_4$, $a_5$, $a_6$ . . . $c_6$ as shown in FIG. 3. Nine beams B1, B2, B3 . . . B9 are associated with the input ports $C_3$, $C_1$, $C_2$ . . . $B_2$ having a progressive phase front which varies between −160° and +160° where beam $B_1$ corresponds to the left-most beam for a left to right phase front impinging on output ports P1 through P9.

When desirable, the 9×9 beam former configuration shown in FIG. 3 can be expanded to an 18×18 beam former by a parallel duplication of the embodiment shown in FIG. 3, but with suitable phase shifters inserted into the input lines connected to the ports A, B and C of the first level of 3×3 matrices. Although these components are not shown, it is well within the purview of one skilled in the art.

Referring now to FIG. 4, shown therein is a 12×12 beamformer matrix comprised of four 3×3 matrices $\mathbf{10}_1$, $\mathbf{10}_2$, $\mathbf{10}_3$ and $\mathbf{10}_4$ each having three input ports A, B and C to provide twelve beam input ports, $A_1$, $B_1$, $A_2$, $B_2$ . . . $C_4$ and providing a respective number of intermediate output ports $a_1$, $b_1$ . . . $c_4$. These intermediate output ports are interlaced to a second level of couplers comprising the 3-dB quadrature couplers 74, 76, 78, 80, 82 and 84 which in turn are coupled to a third level of 3-dB quadrature couplers 86, 88, 90, 92, 94 and 96 which provide twelve output ports P1, P2, P3 . . . P12 as shown. Moreover, the two levels of quadrature couplers 74 . . . 84 and 86 . . . 96 furthermore are coupled together in sets of four couplers along with fixed 45° phase shifters in the outside lines which thereby implement three 4×4 binary Butler matrices $\mathbf{98}_1$, $\mathbf{98}_2$ and $\mathbf{98}_3$ networks which are well known to those skilled in the state of the art. This configuration is similar to the 6×6 beam forming matrix shown in FIG. 2 with the exception that different values of fixed phase shifters are utilized in the connecting lines between the intermediate output ports of the 3×3 matrices $\mathbf{10}_1$, $\mathbf{10}_2$, $\mathbf{10}_3$ and $\mathbf{10}_4$ and the upper level 3-dB couplers 74, 76, 78, 80, 82 and 84. As illustrated in FIG. 4, a pair of fixed phase shifters 100 and 102 having fixed phase shifts of −15° and 30°, respectively, are included in the lines coupled between intermediate output ports $b_1$ and $c_1$ to one of the input ports of the 3-dB couplers 78 and 82. The intermediate output ports $b_2$ and $c_2$ of the second 3×3 matrix $\mathbf{10}_2$ are coupled to the other input ports of the 3-dB couplers 78 and 82 by means of the fixed phase shifters 104 and 106 which provide phase shifts of −45° and −90°, respectively. As to the third 3×3 matrix $\mathbf{10}_3$, the intermediate output ports $a_3$ and $b_3$ are respectively coupled to one of the input ports of the 3-dB couplers 76 and 80 by means of fixed phase shifters 108 and 110 which provide fixed phase shifts of −90° and −45°. And finally, the fourth 3×3 matrix $\mathbf{10}_4$ has its intermediate output ports $a_4$ and $b_4$ coupled to the other input ports of the two 3-dB couplers 76 and 80 by means of fixed phase shifters 112 and 114 respectively providing phase shifts of −30° and −15°. It can be seen that the phase shifts coupled to the outputs of the intermediate output ports of the four matrices $10_1$, $10_2$, $10_3$ and $10_4$ are symmetrical on either side of the two intermediate matrices $12_2$ and $12_3$. Thus where the output port P1 is considered to be the left-most port a progressive phase front for the beams B1 through B12 ranging between −135° and +135° for the ports $A_1$ through $C_4$ is provided as shown.

Thus what has been set forth in this detailed description of the invention is an improved non-binary matrix in the form of a six port junction which can either be duplicated and/or combined with other binary matrices, the simplest of which comprises a four port Butler matrix in the form of a 3-dB quadrature coupler, for forming a predetermined number ($2^n \times 3^m$) of orthogonal sin x/x beams.

While there has been shown and described what is at present considered to be the preferred embodiments of the invention, it should be noted that the foregoing has been made by way of illustration and not limitation. Accordingly, all modifications, alterations and changes coming within the spirit and scope of the invention as defined in the appended claims are herein meant to be included.

I claim:

1. A non-binary orthogonal beam forming network for a plurality of antenna elements and where amplitude and phase characteristics exhibit substantially constant response over a relatively broad frequency range comprising:

at least one six port junction having three input ports and three output ports and including first and second 3-dB quadrature couplers and a 4.8-dB coupler and both of said input ports of said first 3-dB coupler forming said three input ports of said six port junction, one of said output ports of said first 3-dB coupler being coupled to the other of said input ports of said 4.8-dB coupler, −90° fixed phase shift means coupling the other of said output ports of said first 3-dB coupler to one of said input ports of said second 3-dB coupler, said −90° phase shift means comprising at least two parallel sections of coupled strip transmission lines mutually connected at one end, one of said output ports of said 4.8-dB coupler being coupled to the other of said input ports of said second 3-dB coupler, −240° fixed phase shift means coupling the other said output port of said third coupler to an output port forming one of said output ports of said six port junction, said −240° phase shift means also comprising at least two parallel sections of coupled strip transmission lines mutually connected at one end, −30° fixed phase shift means coupling one output port of said second 3-dB coupler to another output port forming the second of said three output ports of said six port junction, said −30° phase shift means also comprising at least two parallel sections of coupled strip transmission lines mutually connected at one end, and the other of said output ports of said second 3-dB coupler forming the remaining output port of said three output ports of said six port junction, whereby a non-binary matrix is formed providing a 120° phase progression.

2. The beam forming network as defined by claim 1 and wherein said −90° fixed phase shift means, said −240° fixed phase shift means and said −30° fixed phase shift means and operate in the TEM mode.

3. The orthogonal beam forming network as defined by claim 1 and further comprising at least another said six port junction thereby providing at least six input ports and at least six output ports, a plurality of additional quadrature couplers each having two input ports and two output ports, and phase shift means selectively coupling said at least six output ports to said input ports of said plurality of additional quadrature couplers whereby said output ports of said plurality of additional quadrature couplers provide a second level of at least six output ports.

4. The beam forming network as defined by claim 3 wherein said plurality of additional quadrature couplers comprise at least three 3-dB four port quadrature couplers.

5. The beam forming network as defined by claim 4 and wherein said phase shift means comprises a plurality of fixed phase shift elements having predetermined phase shift increments of 30°.

6. The orthogonal beam forming network as defined by claim 1 and further comprising a plurality of additional said six port junctions thereby providing n input ports and n output ports, a plurality of other quadrature couplers each having two input ports and two output ports, and phase shift means selectively coupling said n output ports to said input ports of said plurality of quadrature couplers, whereby said output ports of said plurality of quadrature couplers provide a second level of n output ports.

7. The orthogonal beam forming network as defined by claim 6 and further comprising another plurality of said other quadrature couplers each having two input ports and two output ports selectively coupled to said first recited plurality of other quadrature couplers, whereby said output ports of said second plurality of quadrature couplers provide a third level of n output ports.

8. The orthogonal beam forming network as defined by claim 1 and further comprising at least one other said six port junction forming thereby a set of first level six port junctions each having at least three input ports and three output ports, a plurality of additional said six port junctions forming a set of second level six port junctions each having three input ports and three output ports, and coupling means selectively coupling the output ports of said first level six port junctions to the input ports of said second level six port junctions whereby said output ports of said second level six port junctions provide a plurality of second level output ports.

9. The orthogonal beam forming network as defined in claim 8 and wherein said coupling means additionally include phase shift means selectively coupling said output ports of said first level six port junctions to the input ports of said second level six port junctions.

10. The orthogonal beam forming network as defined by claim 9 wherein said phase shift means comprises fixed phase elements having phase shifts which are in multiples of 40°.

11. The orthogonal beam forming network as defined by claim 1 and further comprising a plurality of other said six port junctions forming thereby a level of parallel six port junctions and providing thereby a composite set of input ports and a set of intermediate output ports, a plurality of eight port junctions forming thereby a second level of parallel eight port junctions and providing thereby a composite set of intermediate input ports and a set of output ports, and coupling means selectively coupling said set of intermediate output ports to said set of intermediate input ports.

12. The orthogonal beam forming network as defined by claim 11 wherein said eight port junctions are comprised of eight port Butler matrices respectively including four interlaced four port quadrature couplers.

13. The orthogonal beam forming network as defined by claim 12 wherein said coupling means include phase shift means selectively coupling said intermediate output ports to said intermediate input ports.

14. The orthogonal beam forming network as defined by claim 13 wherein said phase shift means comprises fixed phase elements having phase shifts which are in multiples of 15°.

15. The orthogonal beam forming network as defined by claim 1 and further comprising a plurality of other said six port junctions forming thereby a level of parallel six port junctions and providing thereby a composite set of input ports and a set of intermediate output ports, a plurality of binary matrices selectively coupled together and forming thereby a second level of parallel multi-port junctions and providing thereby a composite set of intermediate input ports and a set of output ports, and coupling means selectively coupling said set of intermediate output ports to said set of intermediate input ports.

16. The orthogonal beam forming network as defined by claim 1 and further comprising a plurality of other said six port junctions forming thereby a level of parallel six port junctions and providing thereby a composite set of input ports and a set of intermediate output ports, and coupling means selectively coupling said set of intermediate output ports to said set of intermediate input ports.

* * * * *